US011713658B2

(12) United States Patent
McGowen

(10) Patent No.: US 11,713,658 B2
(45) **Date of Patent: *Aug. 1, 2023**

(54) METHOD OF LIFTING FLUIDS FROM A PRODUCING FORMATION TO A SURFACE LOCATION

(71) Applicant: DEX-Pump, LLC, Oklahoma City, OK (US)

(72) Inventor: Victor L. McGowen, Oklahoma City, OK (US)

(73) Assignee: DEX-Pump, LLC, Oklahoma City, OK (US)

( * ) Notice: Subject to any disclaimer, the term of this patent is extended or adjusted under 35 U.S.C. 154(b) by 39 days.

This patent is subject to a terminal disclaimer.

(21) Appl. No.: 17/693,771

(22) Filed: Mar. 14, 2022

(65) Prior Publication Data

US 2022/0195851 A1 Jun. 23, 2022

Related U.S. Application Data

(63) Continuation of application No. 16/450,858, filed on Jun. 24, 2019, now Pat. No. 11,274,532.

(60) Provisional application No. 62/688,826, filed on Jun. 22, 2018.

(51) Int. Cl.

| | |
|---|---|
| ***E21B 43/12*** | (2006.01) |
| ***F04D 13/10*** | (2006.01) |
| ***F04B 47/04*** | (2006.01) |

(52) U.S. Cl.
CPC ..... *E21B 43/126* (2013.01); *F04B 47/04* (2013.01); *F04D 13/10* (2013.01)

(58) Field of Classification Search
CPC ..... E21B 43/126; F04B 47/04
See application file for complete search history.

(56) References Cited

U.S. PATENT DOCUMENTS

| | | | | |
|---|---|---|---|---|
| 4,580,952 | A | 4/1986 | Eberle | |
| 4,886,432 | A | 12/1989 | Kimberlin | |
| 2011/0278015 | A1 | 11/2011 | Mazzanti | |
| 2014/0127065 | A1 | 5/2014 | Hansen | |
| 2018/0313347 | A1 | 11/2018 | Tolman et al. | |
| 2020/0399998 | A1 * | 12/2020 | Laing | F04B 23/08 |

* cited by examiner

*Primary Examiner* — Theodore N Yao
(74) *Attorney, Agent, or Firm* — Dunlap Codding, P.C.

(57) ABSTRACT

An artificial lift system for a horizontal well deploys a downhole pump and flexible bladder reservoir chamber to be used with a conventional rod pump. The rod pump is used in the vertical at the top of the curve. The flexible bladder reservoir chamber is connected to the rod pump intake. The downhole pump is set in the producing formation and is connected to the reservoir chamber by tubing. The lift system uses a compressor drive system to operate the downhole pump to move fluids from the producing formation to the reservoir chamber. The reservoir chamber uses the flexible chamber bladder that is filled with well fluids by operation of the downhole pump to provide a continuous supply of well fluids to the rod pump intake. Operation of the rod pump lifts fluids from the flexible chamber bladder without regard to the operation state of the downhole pump.

4 Claims, 8 Drawing Sheets

METHOD OF LIFTING FLUIDS FROM A PRODUCING FORMATION TO A SURFACE LOCATION

CROSS REFERENCE TO RELATED APPLICATIONS

The present application is a continuation of U.S. Ser. No. 16/450,858, filed on Jun. 24, 2019, which claims benefit of U.S. Provisional Application 62/688,826, filed on Jun. 22, 2018; each of which is hereby incorporated herein by reference.

FIELD OF THE INVENTION

The disclosed method and system relate to an artificial lift system for use with a rod pump in horizontal wells and more particularly to a lift system having a downhole pump used to provide fluids to a flexible bladder chamber connected to a rod pump intake.

BACKGROUND OF THE INVENTION

As the oil and gas well is produced, the producing formation pressure is depleted and eventually declines to a point where there is not sufficient formation energy to force liquids to the surface for removal, and the well "dies." Artificial lift is needed in wells when there is insufficient pressure in the producing formation to lift the produced fluids to the surface.

Rod pumps, also known as sucker-rod pumps or beam pumps, are widely used as a reliable and efficient tool for artificial lift. For best results, when a rod pump is utilized, it is installed at or below the depth of the producing formation. This position provides maximum formation pressure reduction and can increase pump efficiency by reducing the effects of "gas locking." In the conventional vertical wellbore this is made possible by drilling through the producing formation and creating a "sump."

In horizontal wells, the wellbore is drilled in a vertical orientation, then by use of special drilling tools, forced into a horizontal orientation. This transitional section of the wellbore is referred to as "the curve." The horizontal portion of the wellbore is intended to intersect significantly more of the producing formation than a vertical wellbore, resulting in greater production potential.

In horizontal wells the use of rod pumps "around the curve" is not efficient. When the rod pump is used as the method of artificial lift in a horizontal well, it is often deployed to the depth where the wellbore begins to transition from vertical to horizontal, or "the Top of the Curve." Installing the rod pump deeper into the wellbore would result in gravitationally induced side loads that will lead to unacceptable wear on the pump, sucker rods and tubing. However, installation of the rod pump at this depth (the Top of Curve) leaves hundreds of feet of restrictive hydrostatic back-pressure of the producing formation.

SUMMARY OF THE INVENTION

The present invention is directed to an artificial lift system for lifting fluids from a horizontal well to a rod pump. The lift system comprises a downhole pump having an intake port and a discharge port, a fluid reservoir chamber having an intake port and a discharge port, a drive system operatively connected to the downhole pump, and at least one pipe connected between the discharge port of the downhole pump and the inlet of the reservoir chamber. The downhole pump comprises a tubular housing defining a drive port and a pump bladder disposed within the housing, such that the pump defines an annulus between an interior of the housing and the bladder. The fluid reservoir chamber comprises a tubular housing and a flexible chamber bladder disposed within the housing, wherein the flexible chamber bladder is in fluid communication with the intake port and the discharge port. The drive system comprises a compressor, a control unit adapted to operate the compressor, and a drive conduit. The drive conduit has a first end connected to the compressor and a second end connected to the drive port of the downhole pump.

In an alternative embodiment, the present invention is directed to a method of lifting fluids from a producing formation to a surface location. The method comprises receiving fluids from the producing formation into a downhole pump, operating the downhole pump using a drive system by repeating the steps of introducing pressurized air into the downhole pump and venting the pressurized air to the surface, receiving fluids from the downhole pump into a flexible bladder of a reservoir chamber, and lifting fluids from the reservoir chamber to the surface location using a rod pump.

In yet another embodiment, the present invention is directed to an artificial lift system for lifting fluids from a horizontal well to a rod pump. The lift system comprises a fluid reservoir chamber having an intake port and a discharge port. The reservoir chamber comprises a tubular housing defining a plurality of vent holes and a flexible chamber bladder disposed within the housing. The chamber bladder is in fluid communication with the intake port and the discharge port. The discharge port is connected to a rod pump intake.

DETAILED DESCRIPTION

The disclosed system and method provide for an improved artificial lift system to be used in conjunction with and to supplement a traditional rod pump. With the disclosed system the rod pump is intended to be used in the vertical portion of the well, at the top of the curve. The disclosed system and method work to lift fluids from a lower position of the horizontal well to the intake of the rod pump, effectively providing a continuous supply of fluid to the rod pump and allowing the rod pump to function efficiently. The lift system comprises a flexible bladder reservoir chamber positioned at the rod pump intake. Well fluids are supplied to the bladder chamber by a non-continuous output downhole pump disposed in the producing formation. The non-continuous output downhole pump has discrete loading and pumping times for lifting fluids to the reservoir chamber. The flexible nature of the bladder reservoir chamber allows the rod pump to operate independent of the downhole pump. The flexible bladder chamber is designed to collapse during operation of the rod pump, providing fluids accessible to the rod pump during the loading cycles of the downhole pump. The lift system design and operation optimize the lift energy needed by requiring the downhole pump to lift fluids only to the height of the reservoir chamber and the rod pump intake.

Figure 1:
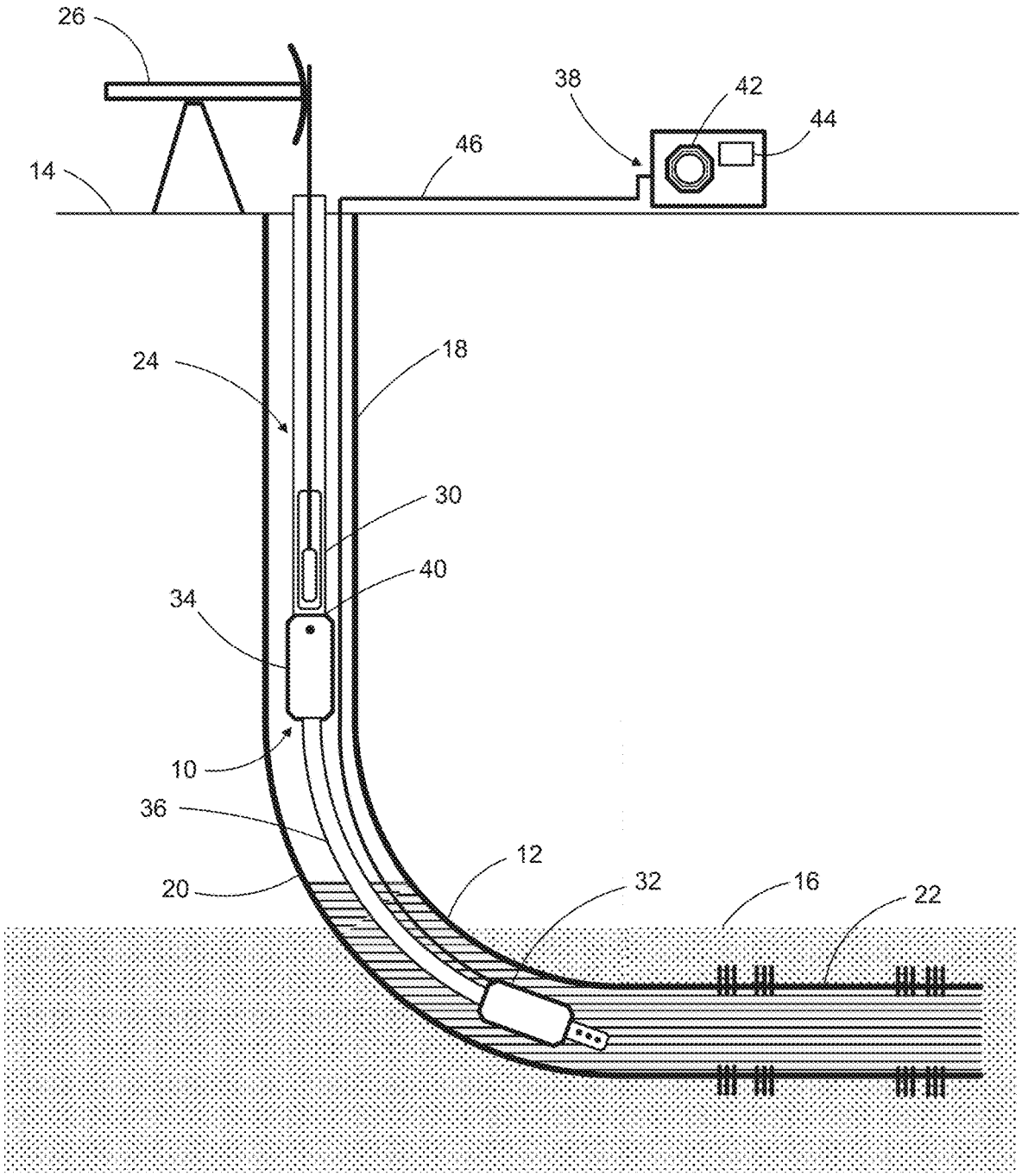
FIG. 1 is an illustration of a representative horizontal well having a rod pump and showing a lift system in accordance with the present invention.

With reference now to the drawings and to FIG. 1 in particular, there is shown therein an artificial lift system, designated by reference numeral 10, in accordance with the present invention. The lift system 10 is shown deployed in a representative horizontal well 12. The horizontal well 12 generally is drilled from a surface position 14 through the earth to a producing formation 16 having oil and gas fluids. The horizontal well 12 comprises a vertical well section 18, a curved section 20, and a horizontal section 22. A casing is typically set in the vertical section, the curved section, and often the horizontal section of the well. The casing provides a permanent path for fluids to pass from the producing formation to the surface and permits for deployment of systems to assist passage of the fluids. A rod pump system 24 is shown deployed in the vertical section 18 of the well. The rod pump system 24 includes a surface unit 26, a plurality of rods, and a pump 30 positioned proximate a top of the curved section 20 of the well. The rod pump system 24 functions to lift accumulated fluids from the rod pump 30 to the surface 14.

The lift system 10 is deployed below the rod pump 30 and in the curved section 20 or the horizontal section 22 of the well 12. The system 10 comprises a downhole pump assembly 32, a fluid reservoir chamber assembly 34, a tail pipe assembly 36, and a pump drive system 38. The downhole pump assembly 32 is preferably deployed and located proximate a bottom of the curved section 20 of the well, adjacent the horizontal section 22 of the well. In this position the pump assembly 32 will have access to fluids in the producing formation and can function to move the fluids to the reservoir chamber assembly 34. The reservoir chamber assembly 34 is positioned at and connected to an intake 40 of the rod pump 24. The tail pipe assembly 36 preferably comprises a plurality of tubing sections. The tubing sections connect the downhole pump assembly 32 to the reservoir chamber assembly 34, providing a path for the fluids moved by the pump assembly to the chamber assembly.

The pump drive system 38 preferably comprises a drive motor 42 positioned on the surface 14, a control unit 44 located adjacent the drive motor, and a drive conduit 46 operatively connecting the drive motor to the pump assembly 32. The drive motor preferably comprises a compressor 42 adapted to produce pressurized gas. The pressurized gas is preferably compressed air, but may also by nitrogen, natural gas, or other suitable gas. Alternatively, the drive system 38 may additionally comprise a cascade tank system (not shown) to allow for efficient use of compressed air from the compressor 42. The drive conduit 46 is preferably a capillary string that extends from the compressor 42 to the pump assembly 32. The capillary string is preferably comprised of stainless steel and deployed as a coiled tubing. The capillary string is preferably banded to the tail pipe assembly 36 and the tubing in the vertical section of the well.

Figure 2:
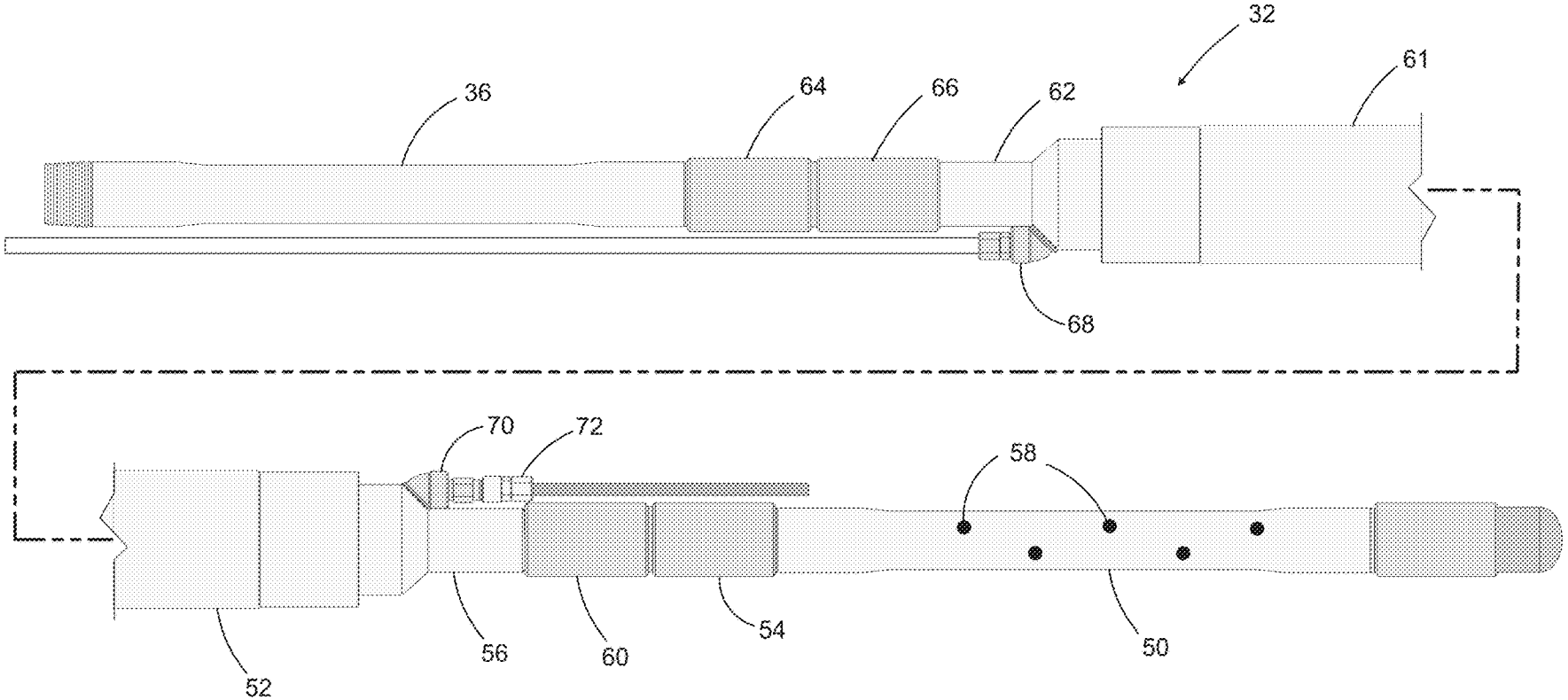
FIG. 2 is a plan view of a downhole pump assembly for use with the lift system.

Turning now to FIG. 2, the downhole pump assembly 32 is shown therein in detail. The pump assembly 32 comprises an intake sub 50 and a downhole pump 52. The intake sub 50 is connected by way of a coupler 54 to the pump 52 at an intake port 56 at a lower end of the pump. The intake sub 50 comprises a tubular section having a plurality of ports 58 to allow fluids in the casing to enter the intake sub. Preferably, the intake sub 50 may comprise filters, screens, or other known mechanisms to filter solid materials from the producing formation fluids that enter the intake sub. The intake sub 50 is in fluid communication with the pump 52 to allow fluids from the casing to enter the intake port 56 of the pump. Preferably, the pump assembly 32 further comprises a bottom check valve 60 disposed between the intake sub 50 and the pump 52. The lower check valve 60 functions to permit fluids to flow in one direction from the intake sub 50 to the pump 52.

The downhole pump 52 comprises a tubular body 61 having an upper end opposing the lower end of the pump. The pump 52 comprises a discharge port 62 at the upper end of the pump. The pump 52 is connected in fluid communication to the tail pipe 36 at an upper end of the pump by way of a coupler 64. Preferably, the pump assembly 32 further comprises an upper check valve 66 disposed between the pump 52 and the tail pipe 36. The upper check valve 66 functions to permit fluids to flow in one direction from the pump 52 to the tail pipe 36. The pump assembly 32 further comprises a drive port 68 and an exhaust port 70. The drive port 68 is preferably located proximate the upper end of the pump and is connected to the drive conduit 46 of the drive system 38. The drive port 68 provides for a fluid path from the drive conduit 46 to the annulus around the pump bladder. The exhaust port 70 is preferably located proximate the lower end of the pump 52 and is connected to a high pressure check valve 72. The exhaust port 70 provides a fluid path from the annulus around the pump bladder to an exterior of the pump housing through the high pressure check valve. The fluid path provided by the exhaust port 70 allows for unwanted fluid buildup to be discharged from the pump 52 in a manner yet to be described.

Figure 3B:
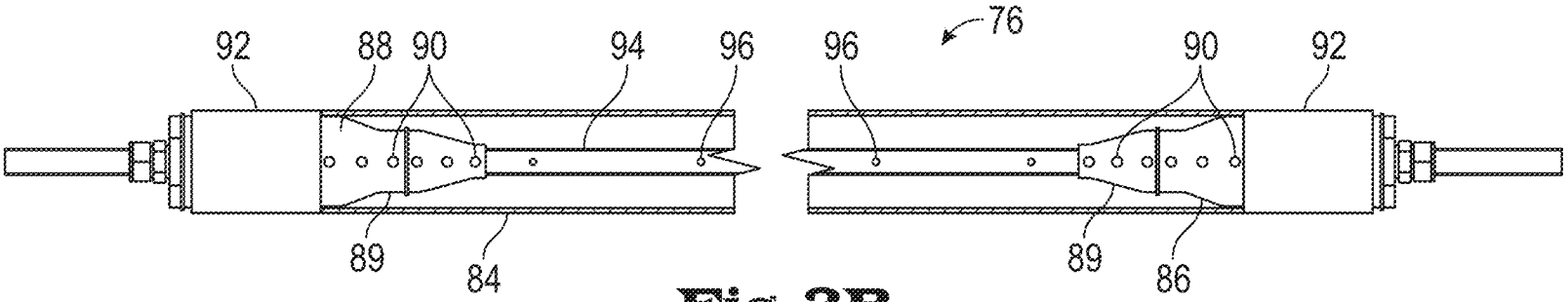
FIG. 3B is a cross-sectional view of a pump bladder assembly.
Figure 3A:
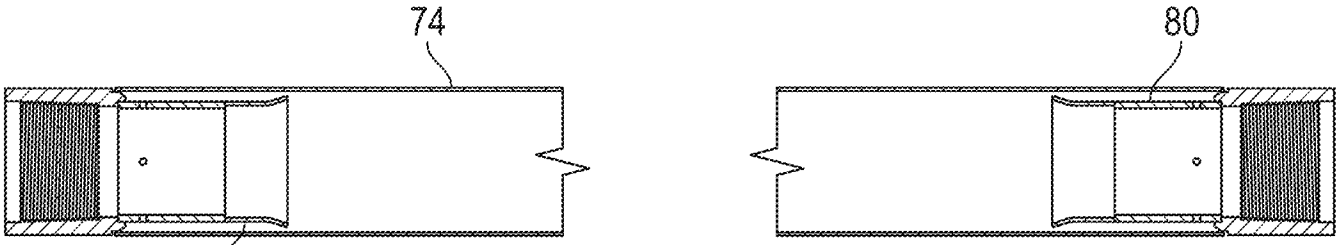
FIG. 3A is a cross-sectional view of a pump housing.
Figure 3:
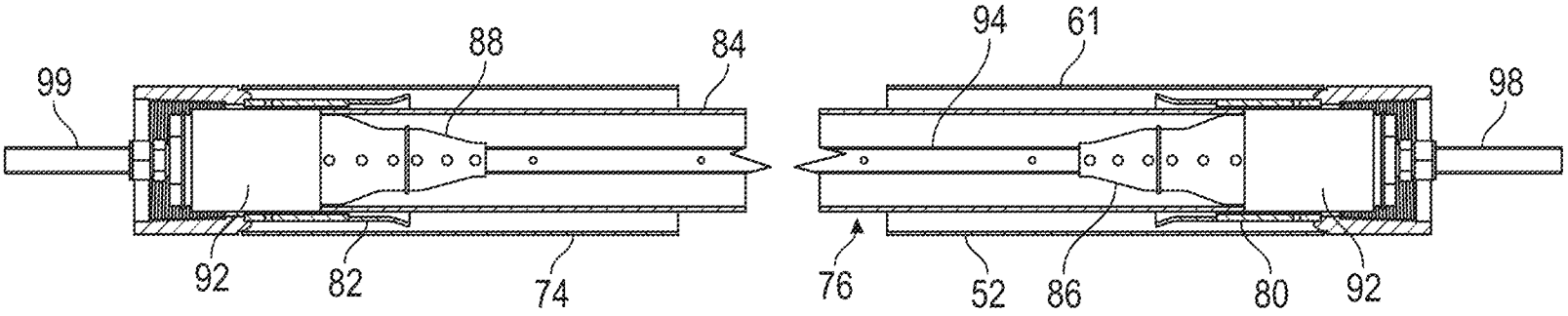
FIG. 3 is a cross-sectional view of a bladder pump for the downhole pump assembly.

With reference now to FIG. 3, the downhole pump 52 is shown in cross-sectional detail. The tubular body 61 of the pump 52 comprises a pump housing 74 and a bladder assembly 76. The pump housing 74 (shown isolated in FIG. 3A) comprises a tubular section having a first end and a second end. The housing 74 further comprises a first bladder flare 80 and a second bladder flare 82. The bladder flares 80 and 82 each comprise a tubular insert having a diameter less than a diameter of the pump housing 74 such that the bladder flares are secured on an interior of the pump housing at the respective ends of the tubular body and allow for an annulus between the bladder flares and the pump housing. The bladder flares 80 and 82 further define an upended flared end, disposed remote from the respective first end and second end of the housing 74.

The bladder assembly 76 (shown isolated in FIG. 3B) comprises a flexible bladder 84 having a first end and a second end. Preferably, the flexible bladder 84 may comprise a rubber hose of nitrile or other material suitable for fluids encountered in well operations. More preferably the hose is formed through an extrusion process, though may be formed through a layering technique. The bladder assembly 76 further comprises first and second end inserts 86 and 88 disposed inside the bladder 84 at the first end and second end of the bladder 84. The end inserts 86 and 88 preferably comprise a tubular shaped end section and a frustoconical tapered section 89. The end inserts 86 and 88 preferably define a plurality of holes 90 or slots in the tapered section 89 to allow for fluid communication through the body of the end inserts. The end inserts 86 and 88 are disposed on an inside of the bladder 84 at the first end and the second end of the bladder, with the tapered sections 89 of the end inserts positioned toward an interior section of the bladder. Preferably the end inserts 86 and 88 are secured to the bladder 84 by crimping a ferrule 92 around an exterior of the bladder to hold the inserts at the respective first end and second end of the bladder. Additionally, glue or other adhesive may be used to retain the end inserts in place.

Preferably, the bladder assembly 76 further comprises a support tube 94 connected between the tapered section 89 of the first and second end inserts 86 and 88. The support tube 94 preferably may comprise a plurality of fluid holes 96 or slots to allow fluid communication through the tube. In operation the support tube 94 provides for the bladder 84 to be collapsed or inflated without creating a seal that would prevent fluid communication through the bladder assembly 76.

With continued reference to FIG. 3, the pump assembly further comprises an intake tube 98 and a discharge tube 99. The intake tube 98, connected at the first end of the bladder assembly 76, defines the intake port 56 and allows for fluid communication from the intake sub 50. The discharge tube 99, connected at the second end of the bladder assembly 76, defines the discharge port 62 and allows for fluid communication to the tail pipe 36.

The design of the downhole pump assembly 32 provides for the pump 52 to be operated by the drive system 36 such that the bladder 84 can be collapsed by pressurized air introduced to the annulus around the bladder through the drive port 68. The collapsing of the bladder 84 will expunge fluids collected in the bladder through the discharge tube 99 and the discharge port 62. In an alternative embodiment, the pump 52 may be designed to collect well fluids in the annulus around the bladder 84 and to expunge the fluids through the discharge port 62 by inflating the bladder. For such a pump 52 operation, the intake tube 98 may comprise holes or ports to allow well fluids to enter the annulus around the bladder 84. The annulus around the bladder 84 would further provide fluid communication past the bladder flare 82 to allow well fluids to pass to the discharge port 62. Additionally, the drive port 62 may be appropriately modified to be part of a transition sub positioned adjacent the upper check valve 66. The transition sub would provide for a drive port transition to an internal pressure tube that would connect through the present discharge tube 99 to provide fluid communication for the drive gas in the drive conduit 46 to the interior of the bladder 84. Introduction of the pressurized drive gas would cause the bladder 84 to inflate, expunging any fluid in the annulus around the bladder to the discharge port 62.

Figure 4:
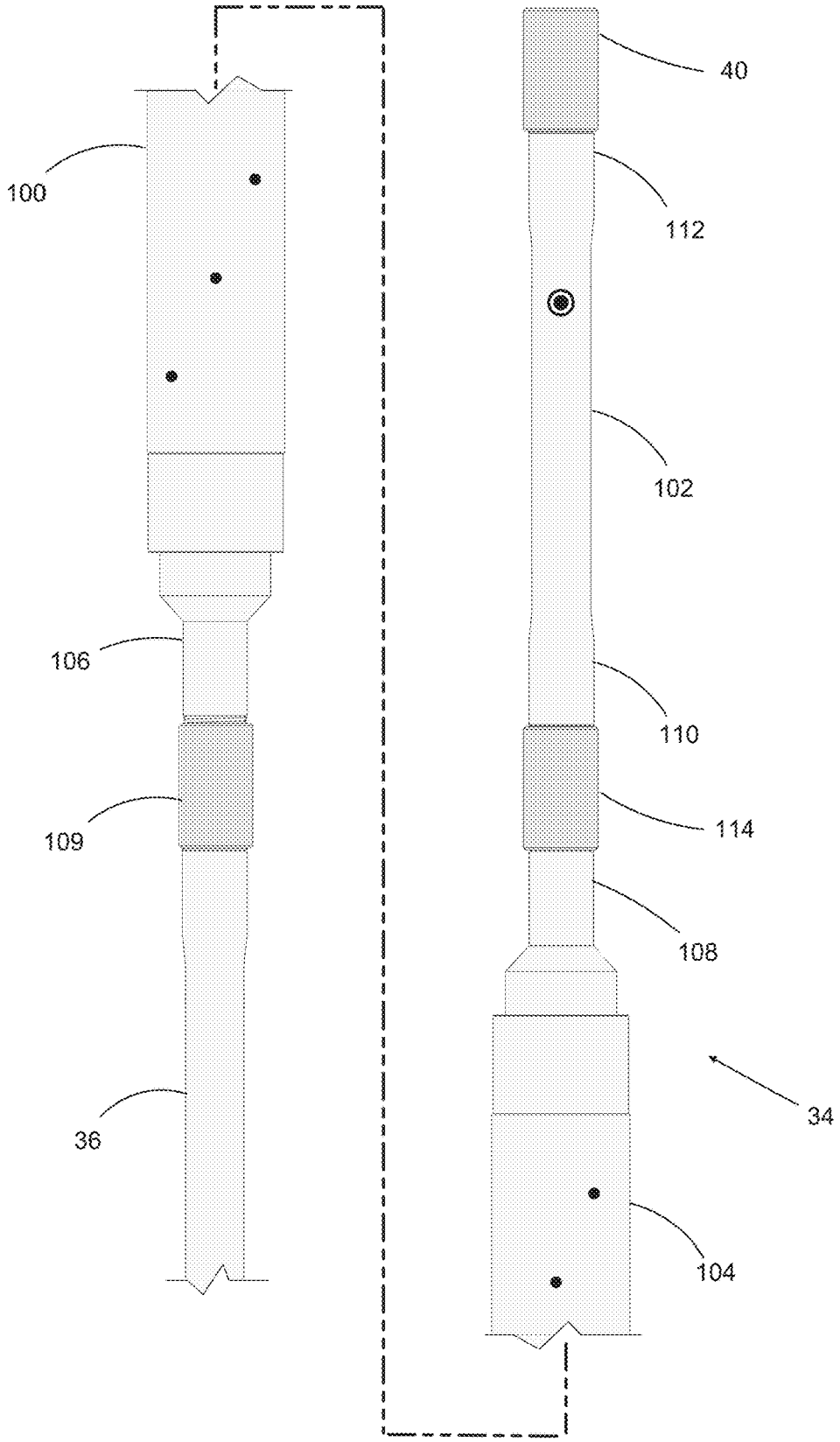
FIG. 4 is a plan view of the fluid reservoir chamber assembly for use with the lift system.

Turning now to FIG. 4, the fluid reservoir chamber assembly 34 is shown therein in detail. The reservoir chamber assembly 34 comprises a reservoir chamber 100 and a vent sub 102. The reservoir chamber 100 comprises a tubular body 104 having a lower end and an opposing upper end. The reservoir chamber 100 comprises an inlet port 106 at the lower end and a discharge port 108 at the upper end. The reservoir chamber 100 is connected in fluid communication to the tail pipe 36 at its lower end by way of a coupler 109.

The vent sub 102 comprises a tubular body having a first end 110 and a second end 112. The first end 110 of the vent sub 102 is connected by way of a coupler 114 to the reservoir chamber 100 at the upper end of the chamber. The second end 112 of the vent sub 102 is connected to the rod pump intake 40. As shown herein, the second end 112 of the vent sub 102 comprises a threaded connection to the rod pump intake 40 in a conventional manner. The vent sub 102 provides a fluid path from the reservoir chamber 100 to the rod pump intake 40.

Figure 5:
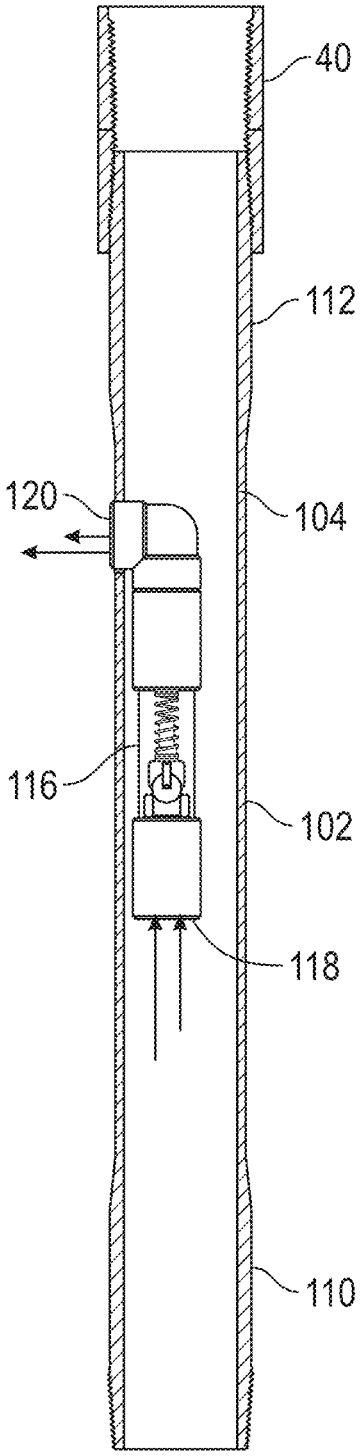
FIG. 5 is a cross-sectional view of vent sub of the chamber assembly.

Referring now to FIG. 5, the vent sub 102 is shown in cross-section and comprises a ball valve 116 disposed on an interior of the tubular body 104. An input port 118 of the valve 116 is oriented toward the first end 110 of the vent sub 102 and is adapted to receive fluid flow from the reservoir chamber. Gas and fluid entering the ball valve 116 under sufficient pressure exit the ball valve through a vent port 120 in a side wall of the tubular body 104. The vent sub 102 and incorporated ball valve 116 permit unwanted gases to vent from the flow to allow the reservoir chamber 100 to pass primarily fluids to the rod pump intake 40. The vent sub 102 also allows venting of excess fluid if the reservoir chamber 100 is full and the rod pump is not operative to remove fluid from the chamber.

Figure 6:
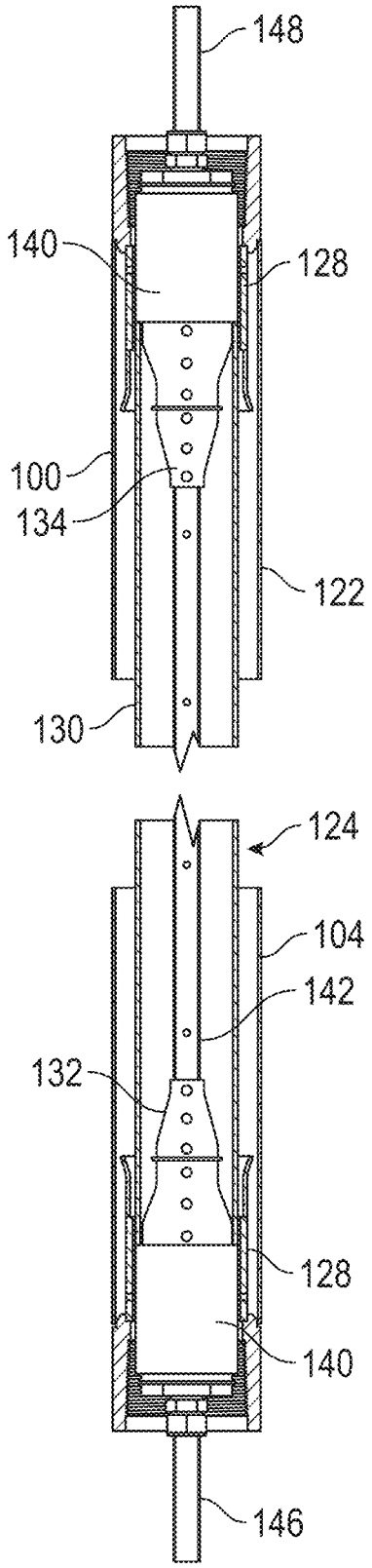
FIG. 6 is a cross-sectional view of a fluid reservoir chamber.
Figure 6A:
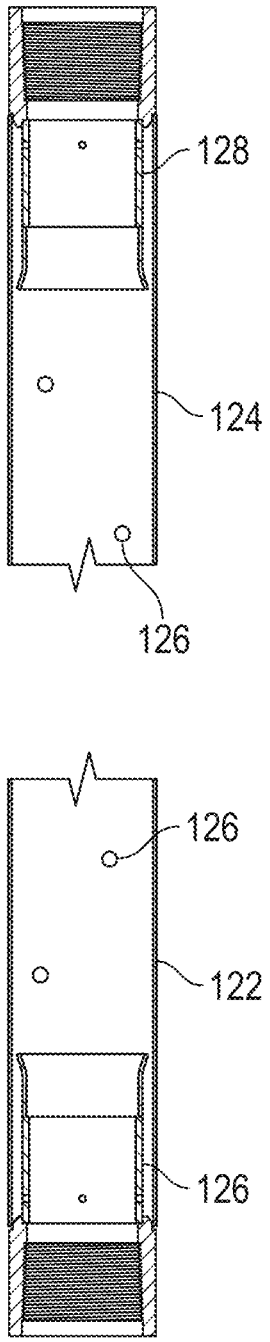
FIG. 6A is a cross-sectional view of a chamber housing.

With reference now to FIG. 6, the reservoir chamber is shown in greater detail. The reservoir chamber 100 comprises a chamber housing 122 and a bladder assembly 124. The chamber housing 122 (shown isolated in FIG. 6A) comprises a tubular section 124 having a first end and a second end and defining a plurality of relief holes 126 or slots. The chamber housing 122 further comprises a first bladder flare 128 and a second bladder flare 128. The bladder flares 126 and 128 each comprise a tubular insert having diameter less than a diameter of the tubular housing 122 such that the bladder flares are secured on an interior of the tubular section at the respective ends of the tubular section and allow for an annulus between the bladder flares and the tubular housing. The bladder flares 126 and 128 further define an upended flared end, disposed remote from the respective first end and second end of the housing 122.

Figure 6B:
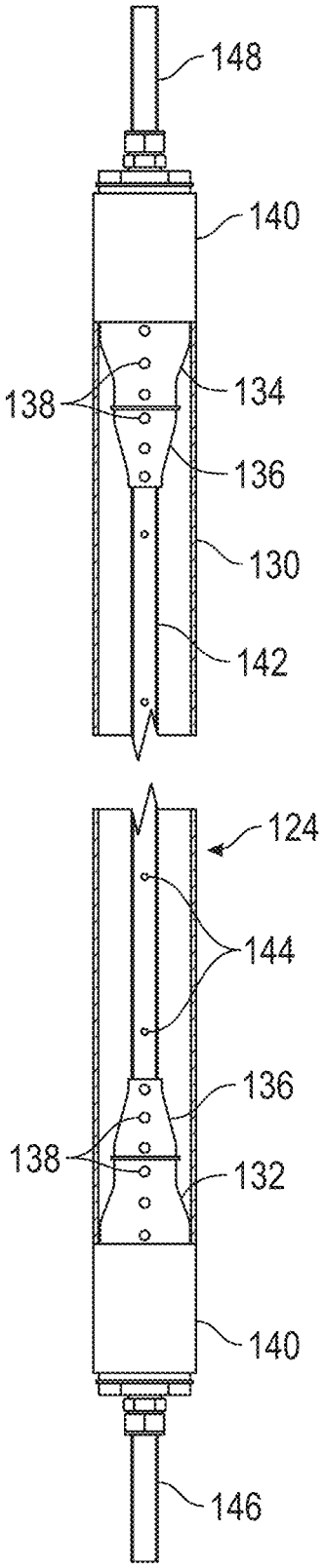
FIG. 6B is a cross-sectional view of a chamber bladder assembly.

The chamber bladder assembly 124 (shown isolated in FIG. 6B) comprises a flexible bladder 130 having a first end and a second end. Preferably, as with the bladder 84 of the downhole pump 52, the flexible bladder 130 may comprise a rubber hose of nitrile or other material suitable for fluids encountered in well operations. More preferably the hose is formed through an extrusion process, though may be formed through a layering technique. The bladder assembly 124 further comprises first 132 and second 134 end inserts disposed inside the bladder 130 at the first end and second end of the bladder. The end inserts 132 and 134 preferably comprise a tubular shaped end section and a frustoconical tapered section 136. The end inserts 132 and 134 preferably define a plurality of holes 138 or slots in the tapered section 136 to allow for fluid communication through the body of the end inserts. The end inserts 132 and 134 are disposed on an inside of the bladder 130 at the first end and the second end of the bladder, with the tapered sections 136 of the end inserts positioned toward an interior section of the bladder. Preferably the end inserts 132 and 134 are secured to the bladder 130 by crimping a ferrule 140 around an exterior of the bladder to hold the inserts at the respective first end and second end of the bladder. Additionally, glue or other adhesive may be used to retain the end inserts in place.

Preferably, the chamber bladder assembly 124 further comprises a support tube 142 connected between the tapered section 136 of the first 132 and second 134 end inserts. The support tube 142 preferably may comprise a plurality of fluid holes 144 or slots to allow fluid communication through the tube. In operation the support tube 142 provides for the bladder 130 to be collapsed without creating a seal that would prevent fluid communication through the bladder assembly 124.

With continued reference to FIG. 6, the reservoir chamber assembly 34 further comprises an intake tube 146 and a discharge tube 148. The intake tube 146, connected at the first end of the bladder assembly 124, defines the intake port 106 and allows for fluid communication from the tail pipe 36 to the bladder 130. The discharge tube 148, connected at the second end of the chamber bladder assembly 124, defines the discharge port 108 and allows for fluid communication from the bladder 130 to the vent sub 102 and ultimately to the rod pump intake 40.

In operation, the lift system 10 comprising the downhole pump 32 and the reservoir chamber 34 operates independent of the rod pump 30 disposed in the vertical section 18 of the well 12 at the top of the curve. Efficient operation of the lift system 10 coordinates operation of the downhole pump 32 as the pump is filled with fluids by nature of the producing formation pressure. In an idle state when the drive system 38 is not operating the pump 32, the drive conduit 46 is vented to atmosphere (or at most to a pressure that is less than the pressure inside the pump bladder 84, which is equal to producing formation pressure) at the surface 14 proximate the compressor 42. This operation is effective to expose the interior of the downhole pump 32, and particularly the annulus between the bladder 84 and the pump housing 74, to atmospheric pressure. At the same time, the interior of the bladder 84 is exposed to the pressure in the well producing formation 16. The resulting pressure differential will allow fluids from the well producing formation 16 to enter the pump bladder 84 through the intake sub 50, the intake check valve 60 and the intake port 56. Given the relative pressures, well producing formation 16 fluids will inflate the bladder 84 to fill the pump housing 74. The first bladder flare 80 and the second bladder flare 82 allow the bladder 84 to expand gradually in the pump housing 74 and reduce stress on the bladder material.

When the bladder 84 is full of well fluids and has expanded to fill the pump housing 74, the drive system 38 is engaged to operate the downhole pump 32. The compressor 42 operates to introduce high pressure air into the drive conduit 46. When the pressure in the drive conduit 46 is greater than the pressure of the fluid in the bladder 84 and sufficient to overcome the column of fluid in the tail pipe 36 and the reservoir chamber 100, the pressurized air from the conduit 46 will enter the pump housing 74 in the annulus around the bladder 84 and cause the bladder to collapse. As the bladder 84 collapses, fluid in the bladder is forced out of the bladder through the bladder discharge port 62, through the discharge check valve 66, and into the tail pipe 36. When the bladder 84 is collapsed, the drive system 38 will shut the compressor 42 off and vent the drive conduit 46 to atmosphere, allowing the system 10 to cycle and begin again so that the bladder can again fill with well fluids.

Figure 7A:
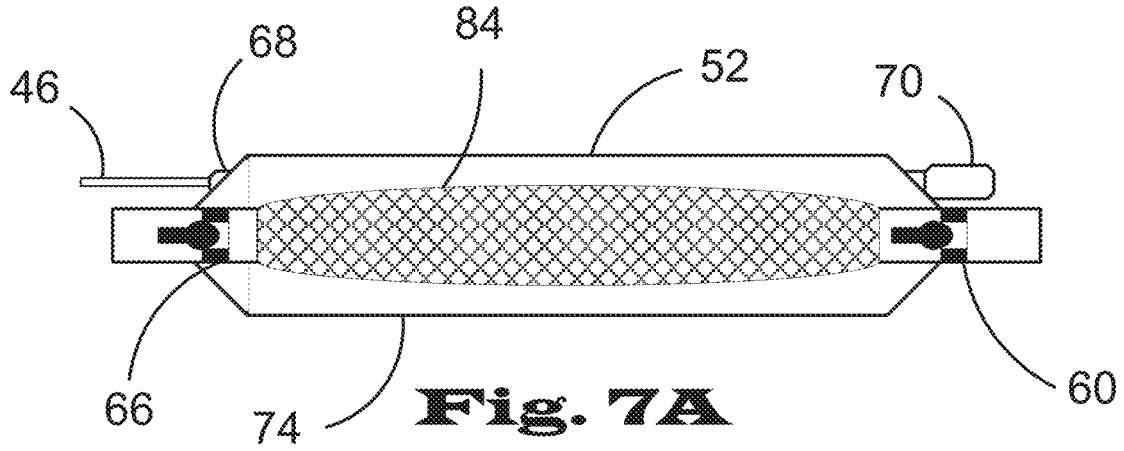
FIG. 7A is an illustration of a stage of the pump bladder operation.
Figure 7B:
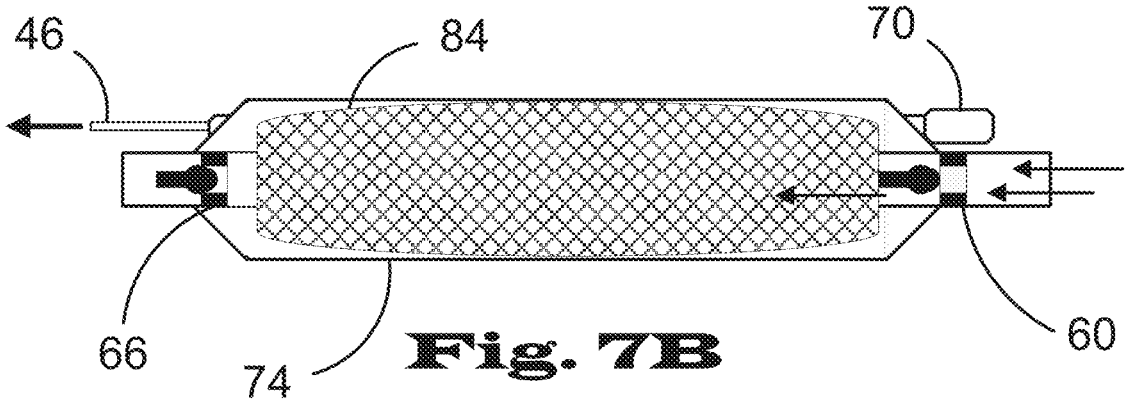
FIG. 7B is an illustration of another stage of the pump bladder operation.
Figure 7C:
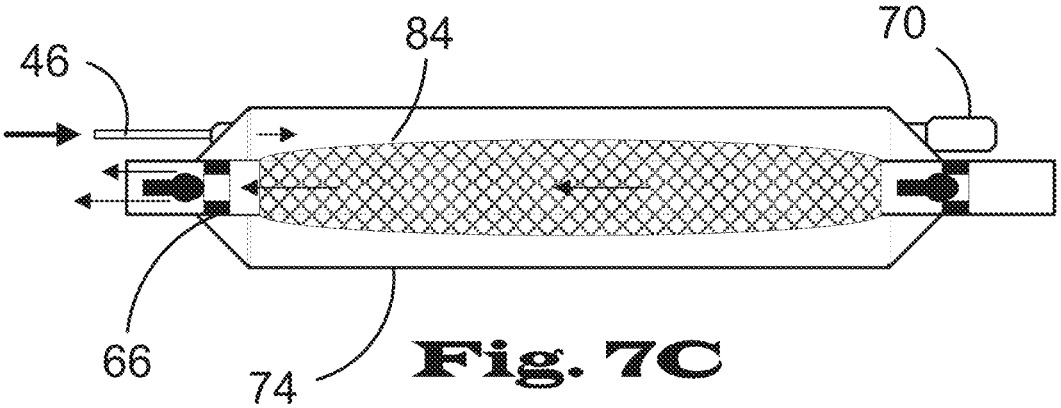
FIG. 7C is an illustration of another stage of the pump bladder operation.
Figure 7D:
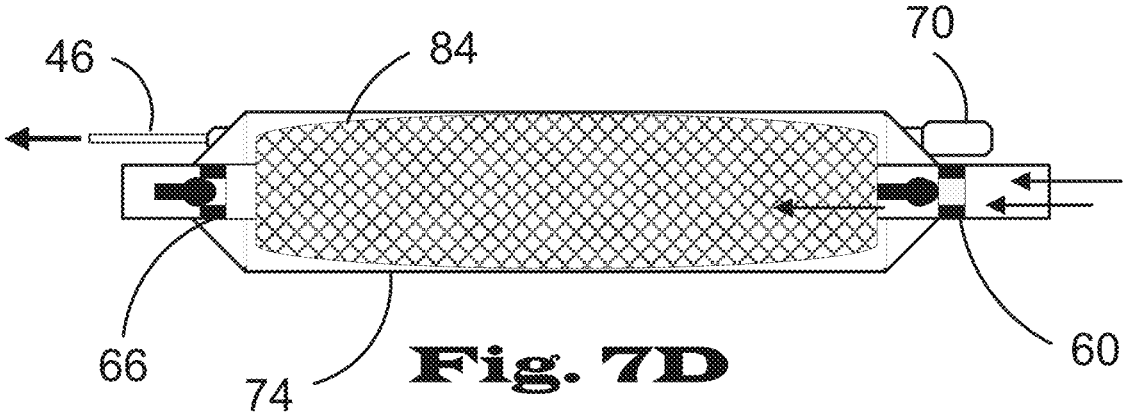
FIG. 7D is an illustration of another stage of the pump bladder operation.

Turning now to FIGS. 7A-D, shown therein is an illustration of the stages of operation of the pump. FIG. 7A shows a partial cross-section of the downhole pump 52, illustrating the pump housing 74, the pump bladder 84, the drive conduit connection 68, the intake check valve 60, and the discharge check valve 66. FIG. 7B illustrates the downhole pump 52 in the idle condition described above, where the drive conduit 46 and the pump housing 74 annulus around the bladder 84 is vented to atmosphere, allowing well producing formation fluid to enter the bladder through the intake check valve 60. FIG. 7C illustrates the downhole pump 52 as the compressor 42 is engaged to pressurize the drive conduit 46 and the annulus around the bladder 84, collapsing the bladder and forcing fluid out of the bladder through the discharge check valve 66 and into the tail pipe 36. Finally, FIG. 7D again shows the annulus pressure vented to atmosphere allowing another pump cycle to begin.

Operation of the downhole pump 52 by the drive system 38 is regulated by the control system 44. The control system 44 may function to alternately vent the drive conduit 46 to atmosphere and pressurize the drive conduit to a pressure sufficient to raise the column of fluid in the tail pipe 36 between the pump 52 and the reservoir chamber 100 based on a time calculation for the venting and pressurization cycles. Alternatively, the control system 44 may sense pressure change rates in the drive conduit 46 during the pressurization and vent cycles to determine when to operate the compressor 42 for most efficient operation. The control system 44 may, for example, limit the venting cycle to venting the drive conduit 46 and the pump housing 74 to a pressure that is less than the producing formation pressure as found in the bladder 84. Additionally, the control system 44 may operate the compressor 42 to expel condensation fluid buildup in the annulus of the pump housing 74. For such purposes, when the pressure has been increased sufficiently to collapse the pump bladder 84 the pressure can continue to be increased to allow any condensation fluid buildup to be forced through the exhaust port 70 of the pump 52.

Figures 8A, 8B, 8C:
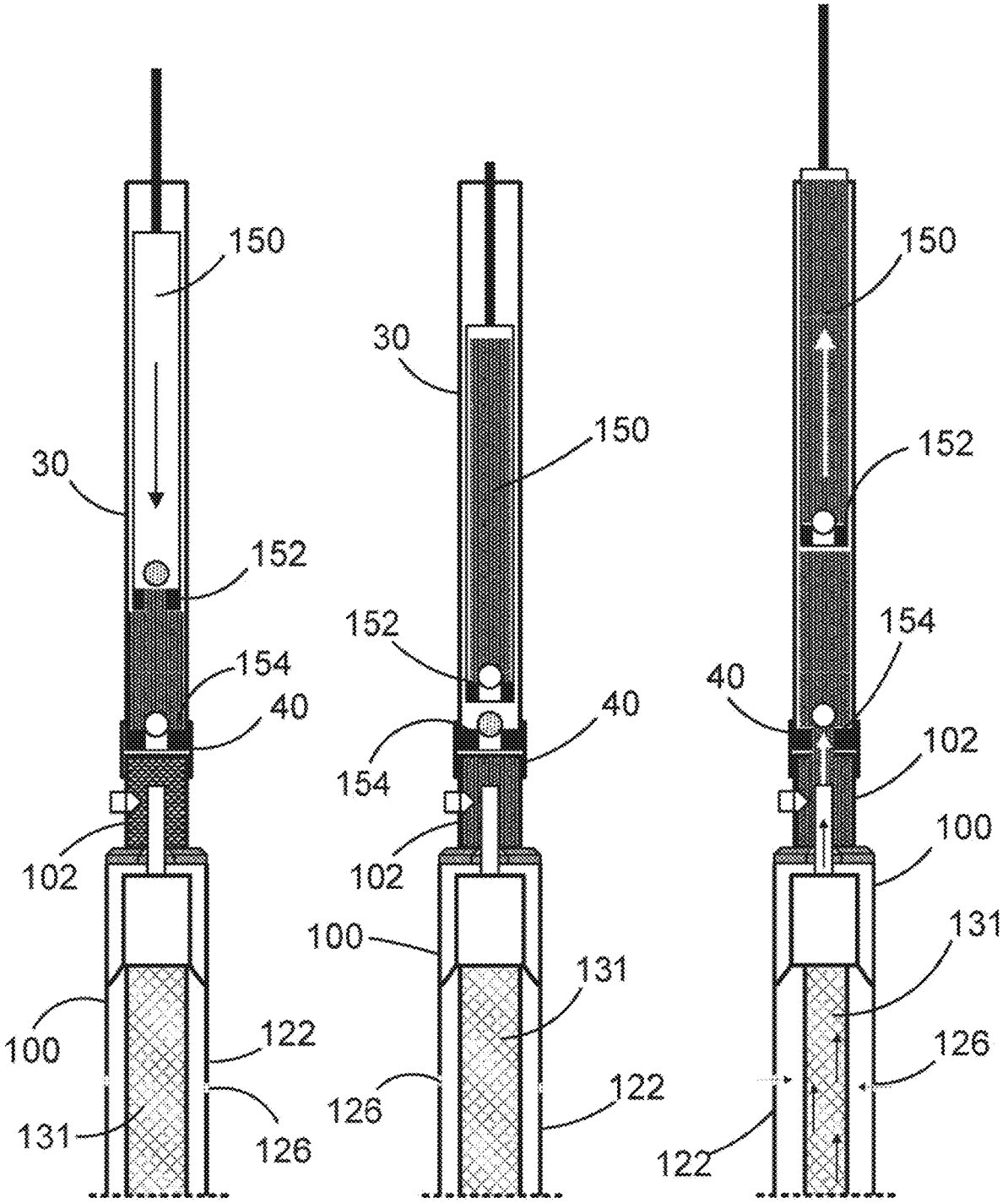
FIG. 8A is an illustration of the rod pump interaction with the reservoir chamber.
FIG. 8B is another illustration of the rod pump interaction with the reservoir chamber.
FIG. 8C is another illustration of the rod pump interaction with the reservoir chamber.

As suggested previously, the downhole pump 52 can be operated continuously and independent of the rod pump 30 because the ball valve 116 in the vent sub 102 will function to vent gases and excess fluid when the reservoir chamber 100 is full. Cycling of the reservoir chamber 100 is dependent on operation of the rod pump 30 that functions to lift fluids from the reservoir chamber to the surface 14. Referring now to FIGS. 8A-C, the interaction of the rod pump 30 with the reservoir chamber assembly 34 is illustrated. FIGS. 8A-C shows an upper portion of the reservoir chamber 100, the vent sub 102, and the rod pump 30. In FIG. 8A, a plunger 150 of the rod pump 30 is shown in the downstroke, with the traveling valve open 152 and the standing valve 154 closed. A moderate amount of fluid is also shown in a bladder chamber 131.

Shown in FIG. 8B, the plunger 150 has completely descended. Also, in FIG. 8B, the bladder chamber 131 has filled with additional fluid resulting from presumptive operation of the downhole pump 52. The bladder chamber 131 is shown expanded in the chamber housing 122, the expansion permitted by the vent holes 126 in the chamber housing that allows gases in the annulus around the bladder 130 to be expelled from the housing. FIG. 8C illustrates the plunger 150 during the upstroke, with the travelling valve 152 closed and the standing valve 154 open because of the vacuum created by the upstroke. Also shown in FIG. 8C, the bladder chamber 131 at least partially collapses as fluid is withdrawn from the bladder chamber 131 through the vent sub 102 as a result of the vacuum created by the upstroke of rod pump plunger 150. As fluid is withdrawn from the bladder chamber 131, the bladder chamber 131 at least partially collapses as gases are permitted to enter the annulus of the chamber housing 122 through the vent holes 126.

Various modifications can be made in the design and production of the present invention without departing from the spirit thereof. Thus, while the principal preferred construction and use of the invention have been explained in what is now considered to represent its best embodiments, it should be understood that the invention may be practiced otherwise than as specifically illustrated and described, and claimed in the following claims.

What is claimed is:

1. A method of lifting fluids from a producing formation to a surface location, the method comprising:

receiving fluids from the producing formation into a downhole bladder pump;

operating the downhole bladder pump with a drive system at the surface location by repeating the steps of:

introducing pressurized gas into the downhole bladder pump; and venting the pressurized gas to the surface location;

receiving the fluids from the downhole bladder pump into a bladder chamber of a reservoir chamber positioned uphole of the downhole bladder pump to cause the bladder chamber to expand; and lifting the fluids from the bladder chamber of the reservoir chamber to the surface location with a rod pump positioned uphole of the reservoir chamber, the rod pump comprising:

a housing having an upper end, a lower end, and a chamber extending through the housing from the upper end to the lower end;

a standing valve located in the housing to permit one way flow of fluid into the chamber of the housing;

a plunger disposed in the chamber of the housing above the standing valve and below the upper end of the housing and adapted for reciprocating movement through at least a portion of the chamber of the housing;

a traveling valve located in the plunger to permit one way flow of fluid into the plunger; and a pull rod having one end connected to the plunger and an opposite end connected to a sucker rod string to affect reciprocating movement of the plunger, wherein the fluids are withdrawn from the bladder chamber by moving the plunger and the traveling valve upwardly relative to the housing and the standing valve, and wherein the bladder chamber at least partially collapses as the fluids are withdrawn from the bladder chamber.

2. The method of claim 1, wherein the downhole bladder pump is operated independently of the rod pump.

3. The method of claim 1, wherein a chamber of the reservoir chamber adjacent and separate from the bladder chamber is vented to an exterior of the reservoir chamber, and wherein gas passes from the chamber to the exterior as the bladder chamber expands, and wherein gas passes into the chamber from the exterior as the bladder chamber collapses.

4. The method of claim 1, wherein at least a portion of the fluids received in the bladder chamber includes a gas, and wherein the method further comprises venting at least a portion of the gas to the exterior of the reservoir chamber downhole of the rod pump.

* * * * *